United States Patent [19]

Beckish

[11] 4,071,251

[45] Jan. 31, 1978

[54] GOLF SWING TRAINING DEVICE

[76] Inventor: John Beckish, 228 W. Mitchell St., Milwaukee, Wis. 53204

[21] Appl. No.: 708,992

[22] Filed: July 26, 1976

[51] Int. Cl.[2] ..... A63B 69/36

[52] U.S. Cl. ..... 273/186 R; 273/191 A

[58] Field of Search ..... 273/191, 192, 186 R, 273/186 C, 186 B

[56] References Cited

U.S. PATENT DOCUMENTS

| | | | |
|---|---|---|---|
| 1,399,761 | 12/1921 | Garland | 273/191 A X |
| 2,756,056 | 7/1956 | Zega | 273/191 A |
| 3,482,838 | 12/1969 | Gibson et al. | 273/191 R X |
| 3,744,799 | 7/1973 | Hightower | 273/191 A X |
| 3,953,035 | 4/1976 | Beckish | 273/192 |

*Primary Examiner*—George J. Marlo
*Attorney, Agent, or Firm*—Richard P. Ulrich

[57] ABSTRACT

A golf swing training device having at least one pair of adjustable and flexible guide rails, the guide rails controlling the swing path and swing plane of a golf club swung between them. A clubhead guide may also be incorporated in the device to insure that the clubhead does not top the ball. The flexible guide rail is supported by a spring construction which permits the flexible guide rail to swing away from the other guide rail in response to impacts with the shaft of the golf club. The flexible guide rail includes an audible signaling device and the ends of such rail are positioned at an angle with the plane of the other guide rail to facilitate guiding the golf club into the hitting zone.

8 Claims, 5 Drawing Figures

GOLF SWING TRAINING DEVICE

BACKGROUND AND SUMMARY OF THE INVENTION

This invention relates to golf swing training or practice devices of the type which provide a defined path along which a club must proceed. Professional golfers have discovered that a swing which produces maximum distance and accuracy has well defined characteristics. Those characteristics may be defined in terms of swing plane (the plane swept by the golf club during a swing) and swing path (the path followed by the club head during a swing). Unfortunately, the literature uses a jargon which is descriptive of the results of a poor swing, or descriptive of the action of the body during a swing such as: "late hit", "hitting early" or "tilt angle". Although a good swing may be defined in terms of swing plane and swing path, that does not mean that there is only one correct swing plane and path for all golfers. If there were only one correct plane and path, there would be no need for this invention. However, there are probably as many correct swing planes and paths as there are golfers. The correct plane and path for each person depends upon such factors as his height, weight, musculature and physical condition. Therefore, each person must first determine what path and plane is best for him and then seek to groove his swing so that he achieves perfect reproducability. Perhaps the easiest way to find the right "swing for you" is to solicit the aid of a teaching professional. Then the machine could be used to groove that swing. However, the machine, which is the subject of this application, could be used to set-up and try out various combinations until the one which produces the best results is found.

Ideally a swing training device should control the actions of the body used to produce the desired swing. Unfortunately, that would be very difficult to do, so this invention does the next best thing by informing the user if he deviates from the desired swing and by providing as much or as little control over the swing plane and path as the user desires.

In learning to swing properly with this device one should initially set-up as many constraints on the swing as practicable to insure a correct swing each time and then gradually remove them as his mind and body learns to swing properly until finally no constraints at all are used and he is swinging freely. The prior art does not provide this kind of flexability. Either the devices rigidly control the swing at all times or they provide very little control at all times.

Therefore, it is an object of this invention to provide a swing training device which may be adapted to the needs of the user as he progresses from novice to expert.

It is a further object of this invention to provide adjustable means for setting-up a swing plane desired by the user.

It is an additional object of this invention to inform the user if he deviates from the chosen swing plane and path.

It is a further object of this invention to control the golf club so that the club is required to follow a predetermined path.

It is an additional object of this invention to provide swing correction even though the swing is initiated incorrectly.

It is a further object of this invention to provide a swing training device which can be used on the playing surface of the golf course, including the putting surface.

DESCRIPTION OF THE PREFERRED EMBODIMENTS

Figure 1:
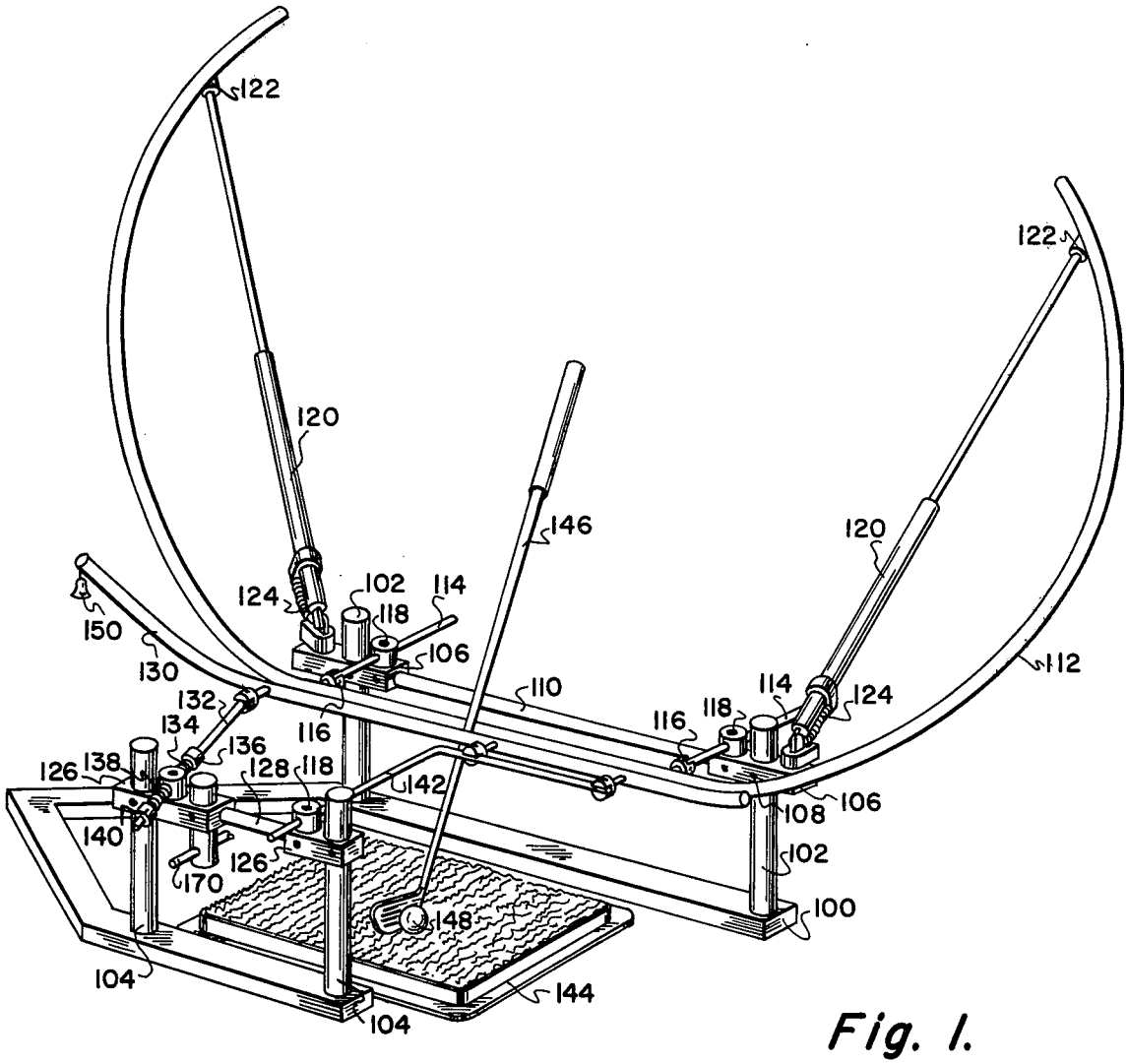
FIG. 1 shows a first form of the invention in which a first pair of arcuate rails are used to guide a golf club.

Referring to FIG. 1, mounted on base 100 are a first pair of posts 102 and a second pair of posts 104. Blocks 106 are attached to posts 102 with set screws 108 and are held together with tubing 110. Blocks 106, set screws 108 and tubing 110 provide the means for adjusting the elevation of arcuate guide rail 112. Rods 114 are pivotably attached to guide rail 112 by pivot member 116 on one end and slidably attached to blocks 106 by set screws 118 on the other thereby providing a pair of means for adjusting the horizontal position of guide rail 112. Telescoping rods 120, the length of which may be adjusted by any convenient means, are pivotably attached to guide rail 112 by pivot member 122 at one end and pivotably attached to blocks 106 by pivot member 124 on the other end. The combination of elements 120, 122 and 124 provide the means for adjusting the angle of inclination of guide rail 112 with respect to the hitting surface.

Blocks 126 are slidably attached to posts 104 by any convenient means and held together with tubing 128. Blocks 126 and tubing 128 provide the means for adjusting the elevation of arcuate guide rail 130. Rod 132 is pivotably attached to guide rail 130 on one end and springingly attached to block 126 on the other end. The spring attachment comprises spring 134 which is located on one side of block 126 and is adjustably positioned by stop 136 on rod 132 and spring 138 which is located on the other side of block 126 and is adjustably positioned by stop 140, thereby providing adjustable spring tension and the means for adjusting the horizontal position of guide rail 130. Although rod 142 could also be springingly attached to block 126 it is shown with a simple slidable attachment. Rod 142 is formed into a 90° angle to provide better visability of the golf ball. Mat 144, golf club 146 and golf ball 148 are shown in FIG. 1 for completeness but are no part of this invention. Bell 150 is attached to rail 130 and acts as a detection device in case of an incorrect swing.

Figure 2:
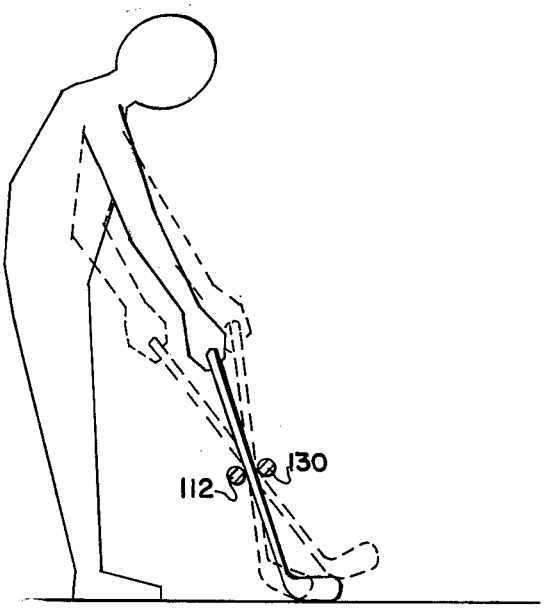
FIG. 2 shows the deviation from a desired swing plane which is possible when using the configuration shown in FIG. 1.
Figure 3:
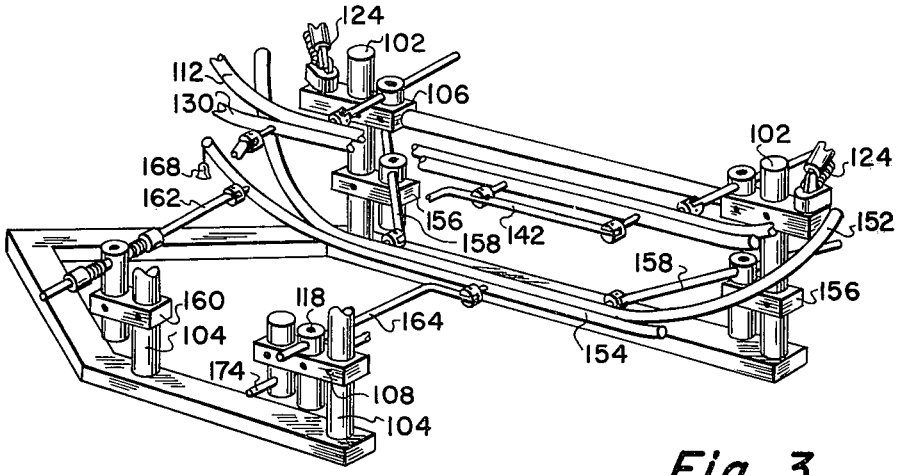
FIG. 3 shows another form of the invention in which a second pair of arcuate rails are added.

It is contemplated that this invention often will be used in the form shown in FIG. 1 since a considerable amount of control over the swing is provided in that form. Probably enough for those persons who are fairly accomplished golfers. However, as is shown in FIG. 2, it is still possible to deviate from the desired swing plane. To insure that the desired swing plane is maintained on every swing, it is contemplated that the user may add arcuate guide rails 152 and 154 which are shown in FIG. 3. This pair of rails is positioned so that they are below, slightly forward of, and approximately parallel to rails 112 and 130 in the hitting zone. Rails 152 and 154 are approximately parallel to each other in the hitting zone and the separation between them is slightly wider than the diameter of the shaft of the golf club passing between them. When setting-up the machine rails 112 and 130 and 150 and 154 are adjusted so that a golf club passing between each pair of rails will lie in the desired swing plane.

Blocks 156 are each slidably mounted on posts 102 and provide the means for adjusting the elevation of rail 152. Rods 158 which are slidably attached to blocks 156 and pivotably attached to guide rail 152, provide the means for adjusting rail 152 horizontally.

Blocks 160 are slidably attached to posts 104 and provide the means for adjusting the elevation of rail 154. Rod 162 is pivotably attached to rail 154 on one end and springingly attached to block 160 on the other. The spring attachment is similar to that described in connection with rod 132 and will not be described at this point. Rod 164 is pivotably attached to rail 154 on one end and slidably attached to block 160 on the other. It is within the contemplation of this invention that rod 164 could be springingly attached to block 160. Bell 168, which is attached to rail 154, rings when the user deviates from the proper swing plane and strikes rail 154 with the shaft of his golf club.

Figure 4:
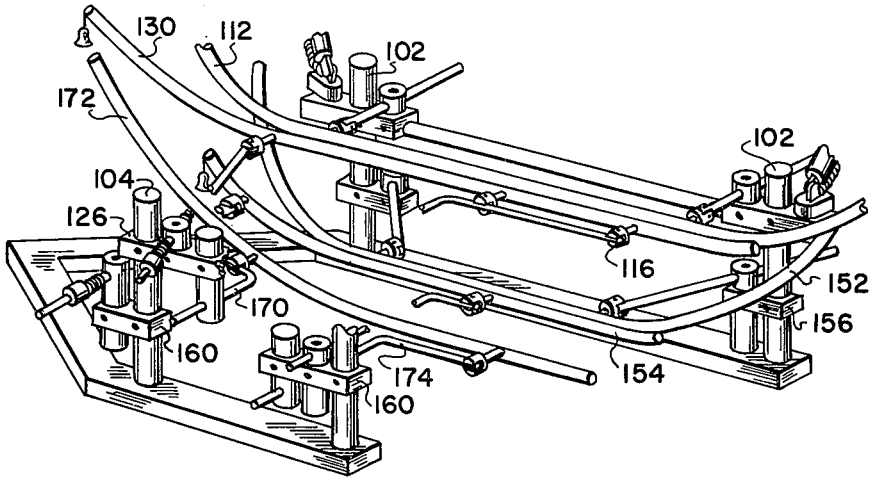
FIG. 4 shows a form of the invention which includes a member for guiding the head of a golf club.

If the user is having difficulty striking a golf ball in the middle, he may want to add an additional feature of this invention which is the means for guiding the head of his golf club into the golf ball. Referring to FIG. 4, the head guiding means comprises rod 170 which is slidably and rotatably attached to block 126 on one end and pivotably attached to arcuate head guide member 172 on the other end and rod 174 which is slidably and rotatably attached to head guide number 172 on one end and slidably and rotatably attached to block 160 on the other end. Head guide member is adjusted so that the head of a golf club will pass between it and the hitting surface during the swing. The arc of the head guide provides the means for steering the head into the ball.

Figure 5:
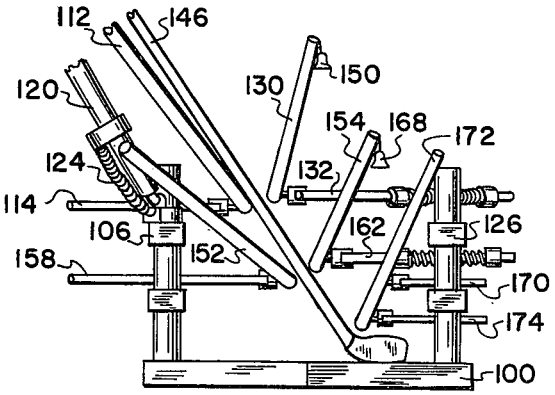
FIG. 5 shows a side view of the invention.

FIG. 5 is a side view of the invention which shows the interrelationship of the guide rails and the way in which the swing plane is established by the rails.

OPERATION

To set up the device the user first adjusts the elevation, horizontal position and angle of inclination of rail 112. This adjustment establishes the desired swing plane. If the user's clubs have been properly adjusted for him, the swing plane can be determined by placing the club to be used on the hitting surface resting it against rail 112 and then adjusting the inclination of the rail until the rail is inclined the same amount as the shaft of the club. The swing plane may also be established by a teaching professional or by the user himself by trial and error. After rail 112 is adjusted, rail 130 is adjusted until the separation between rail 112 and rail 130 in the hitting zone is slightly greater than the shaft diameter of the club being used. With the club still in place rails 152 and 154 are adjusted similarly and finally club head guide member 172 is adjusted so that the club head will just pass under it.

After the initial set-up, the user swings the club he has chosen while positioned in the machine and if he swings perfectly he will not ring any bells. If he doesn't swing perfectly, one or more bells will ring. Repeated use of the machine will result in a perfectly grooved swing the feel of which will be impressed upon the mind of the user and result in lowered golf scores during actual play.

I claim:

1. A golf Swing training device comprising:

a. a base having a first pair and second pair of posts mounted thereon;

b. a first arcuate guide rail;

c. means for adjusting the elevation of the first guide rail said first guide rail elevation adjusting means being movably attached to each of said first pair of posts;

d. means for adjusting said first guide rail horizontally, said first guide rail horizontal adjusting means being pivotably attached to said first guide rail on one end, and movably attached to said first guide rail elevation adjusting means on the other end;

e. means for adjusting the angle of inclination of said first guide rail, said first guide rail angular adjustment means being pivotably attached to the elevation adjustment means at one end and pivotably attached to the first guide rail on the other;

f. a second arcuate guide rail positioned in proximity with said first guide rail and adjusted to provide a passageway between the two rails, slightly larger than the diameter of the shaft of a golf club.

g. means for adjusting the elevation of said second guide rail, said second guide rail elevation adjusting means being movably attached to said second pair of posts;

h. means for adjusting said second guide rail horizontally, said second guide rail horizontal adjustment means being pivotably attached to said second guide rail on one end and springingly attached to said second guide rail elevation adjusting means on the other end so that the second guide rail will swing away from the first guide rail in response to the impact of the shaft of a golf club.

2. The golf swing training device as claimed in claim 1 which further comprises:

an additional pair of flexibly mounted arcuate guide rails, the guide rails being positioned approximately parallel to each other in the hitting zone, positioned below the first and second guide rails separated from each other a distance sufficient to allow a club to pass between them, and adjustably positioned so that a club passing between them and first and second guide rails will be in a desired swing plane.

3. The golf swing training device as claimed in claim 2 which further comprises:

an arcuate head guide member adjustably mounted a sufficient distance above the hitting surface to allow the head of a golf club to pass thereunder, the arc of the head guide member providing the means for guiding the club head to the ball in the hitting zone.

4. The golf swing training device as claimed in claim 3 further comprising detection means attached to the second guide rail and the additional pair of guide rails whereby the user is signaled when his swing is defective.

5. A golf swing training device comprising:

a. a first arcuate guide rail;

b. means for adjusting the angle of inclination of said first guide rail so that the rail may be positioned at an angle with the hitting surface representing a desired swing plane;

c. means for adjusting the elevation of the first guide rail so that the first guide rail may be placed in a position relative to the hitting surface which supports the golf club near the head end during a swing;

d. a second arcuate guide rail adjustably positioned and flexibly mounted approximately parallel to the first arcuate guide rail in the hitting zone and separated therefrom a sufficient distance to allow a club to pass therebetween, the ends of said second guide rail being positioned at an angle with the plane of said first arcuate guide rail to facilitate guiding a club into the hitting zone.

6. The golf swing training device as claimed in claim 5 which further comprises:

an additional pair of flexibly mounted arcuate guide rails, the guide rails being positioned approximately parallel to each other in the hitting zone, positioned below the first and second guide rails, separated from each other a distance sufficient to allow a club to pass between them, and adjustably positioned so that a club passing between them and first and second guide rails will be in a desired swing plane.

7. The golf swing training device as claimed in claim 6 which further comprises:

an arcuate head guide member adjustably mounted a sufficient distance above the hitting surface to allow the head of a golf club to pass thereunder, the arc of the head guide member providing the means for guiding the club head to the ball in the hitting zone.

8. The golf swing training device as claimed in claim 7 further comprising detection means attached to the second guide rail and the additional pair of guide rails whereby the user is signaled when his swing is defective.

* * * * *